US007237403B2

(12) United States Patent
Salt

(10) Patent No.: US 7,237,403 B2
(45) Date of Patent: Jul. 3, 2007

(54) REFRIGERATED CABINET

(75) Inventor: Richard George Phillip Salt, Christchurch (NZ)

(73) Assignee: Skope Industries Limited, Christchurch (NZ)

( * ) Notice: Subject to any disclaimer, the term of this patent is extended or adjusted under 35 U.S.C. 154(b) by 177 days.

(21) Appl. No.: 10/541,437

(22) PCT Filed: Feb. 2, 2004

(86) PCT No.: PCT/NZ2004/000019

§ 371 (c)(1),
(2), (4) Date: Jul. 5, 2005

(87) PCT Pub. No.: WO2004/068048

PCT Pub. Date: Aug. 12, 2004

(65) Prior Publication Data

US 2006/0096311 A1 May 11, 2006

(30) Foreign Application Priority Data

Jan. 31, 2003 (NZ) ..... 523967

(51) Int. Cl.
*F25D 17/04* (2006.01)

(52) U.S. Cl. ..... 62/408; 62/511

(58) Field of Classification Search ..... 62/186, 62/419, 404–408, 426, 511; 454/191–193
See application file for complete search history.

(56) References Cited

U.S. PATENT DOCUMENTS

| | | | | |
|---|---|---|---|---|
| 2,305,075 | A * | 12/1942 | Gilpin | 62/418 |
| 4,339,928 | A * | 7/1982 | Guibert | 62/62 |
| 5,209,073 | A | 5/1993 | Thomas | |
| 5,377,498 | A | 1/1995 | Cur | |
| 5,678,413 | A * | 10/1997 | Jeong et al. | 62/89 |
| 5,687,580 | A * | 11/1997 | Jeong et al. | 62/186 |
| 5,765,388 | A | 6/1998 | Jeon | |
| 5,921,104 | A | 7/1999 | Chang | |
| 5,970,736 | A * | 10/1999 | Gong et al. | 62/408 |
| 6,012,384 | A * | 1/2000 | Badalament et al. | 99/475 |
| 6,431,060 | B1 * | 8/2002 | Gutheim | 99/475 |
| 6,519,962 | B1 * | 2/2003 | Schuetter | 62/255 |
| 6,564,566 | B2 * | 5/2003 | Kim et al. | 62/225 |
| 6,604,377 | B2 * | 8/2003 | Watanabe et al. | 62/408 |
| 6,675,604 | B2 * | 1/2004 | Lee et al. | 62/407 |
| 6,684,657 | B1 * | 2/2004 | Dougherty | 62/237 |
| 6,957,549 | B2 * | 10/2005 | Kim et al. | 62/408 |

FOREIGN PATENT DOCUMENTS

| | | | |
|---|---|---|---|
| JP | 05332665 | | 12/1993 |
| JP | 11159937 | A2 | 6/1999 |
| JP | 2002-90053 | A * | 3/2002 |
| JP | 200340408 | | 8/2003 |
| JP | 2003240407 | | 8/2003 |

* cited by examiner

*Primary Examiner*—Mohammad M. Ali
(74) *Attorney, Agent, or Firm*—McCormick, Paulding & Huber LLP

(57) ABSTRACT

A refrigerated cabinet includes a fan assisted refrigeration unit and a duct in communication with the fan, for distributing cold air from the fan throughout the cabinet; the duct is substantially the full width and the full length of the product storage of the cabinet and at least a major portion of the duct has a substantially constant width; one end of the duct is in communication with a fan and the opposite end of the duct provides an end outlet; intermediate outlets are formed through the duct between the ends, to supply air from the duct to the product storage portion of the cabinet; the size of the end outlet is substantially smaller than the size of the intermediate outlets, so that in use the duct is pressurized compared to the remainder of the cabinet.

6 Claims, 3 Drawing Sheets

REFRIGERATED CABINET

TECHNICAL FIELD

The present invention relates to an improvement in a refrigerated cabinet of the type in which cold air is circulated around the cabinet by a fan.

BACKGROUND ART

For efficient refrigerated storage of product within the cabinet, it is important that cold air from the refrigeration unit is circulated evenly throughout the cabinet. In known designs, the evaporator of the refrigeration unit is fitted with one or more fans, which are driven to circulate cold air from the vicinity of the refrigeration unit throughout the body of the cabinet. However, air naturally tends towards the path of least resistance, and if the shelves of the cabinet are heavily stacked with product, restricting the spaces between adjacent shelves, air tends to move preferentially towards the opposite end of the cabinet from the fan, rather than between the shelves.

DISCLOSURE OF INVENTION

It is therefore an object of the present invention to provide a refrigerated cabinet in which the above described problem is overcome or at least ameliorated.

A refrigerated cabinet which includes a fan assisted refrigeration unit and a duct in communication with said fan, said duct being adapted to distribute cold air from said fan throughout said cabinet;

wherein said duct extends substantially the full width and the full length of the product storage portion of the cabinet and at least a major portion of said duct has a substantially constant width; one end of said duct being in communication with the fan and the opposite end of said duct providing an end outlet; the portion of said duct between said ends being formed with a plurality of intermediate outlets adapted to supply air from said duct to the product storage portion of the cabinet; the size of said end outlet being substantially smaller than the size of said intermediate outlets, such that in use air in said duct is pressurized compared to the remainder of said cabinet.

The end outlet may be formed in any suitable manner, e.g. by forming an aperture through the duct at or adjacent the end of the duct or by forming a flange which extends across part of the width of the duct and so forms an end outlet of reduced size.

The fan assisted refrigeration unit may be mounted at any of a variety of positions on the cabinet, e.g. at the top of the cabinet or at the base of the cabinet or at one of the ends of the cabinet.

The degree of pressurization of the air in the duct compared to the remainder of the cabinet can be varied to suit the size and shape of the cabinet and the degree of refrigeration required. Typically, a pressure increase in the duct of about 60% compared to the remainder of the cabinet for a refrigerated cabinet which has a top mounted fan assisted refrigeration unit, is found to give good results in practice.

BRIEF DESCRIPTION OF DRAWINGS

By way of example only, preferred embodiments of the present invention are described in detail, with reference to the accompanying drawings, in which:

Referring to FIG. 1, a refrigerated cabinet 2 is of known type:- an insulated cabinet with a full height glazed door 3 and a top mounted refrigeration unit 4. The cabinet 2 is mounted on castors 5. The interior of the cabinet is provided with racks or shelves 6 on which product 7 is displayed.

Figure 1:
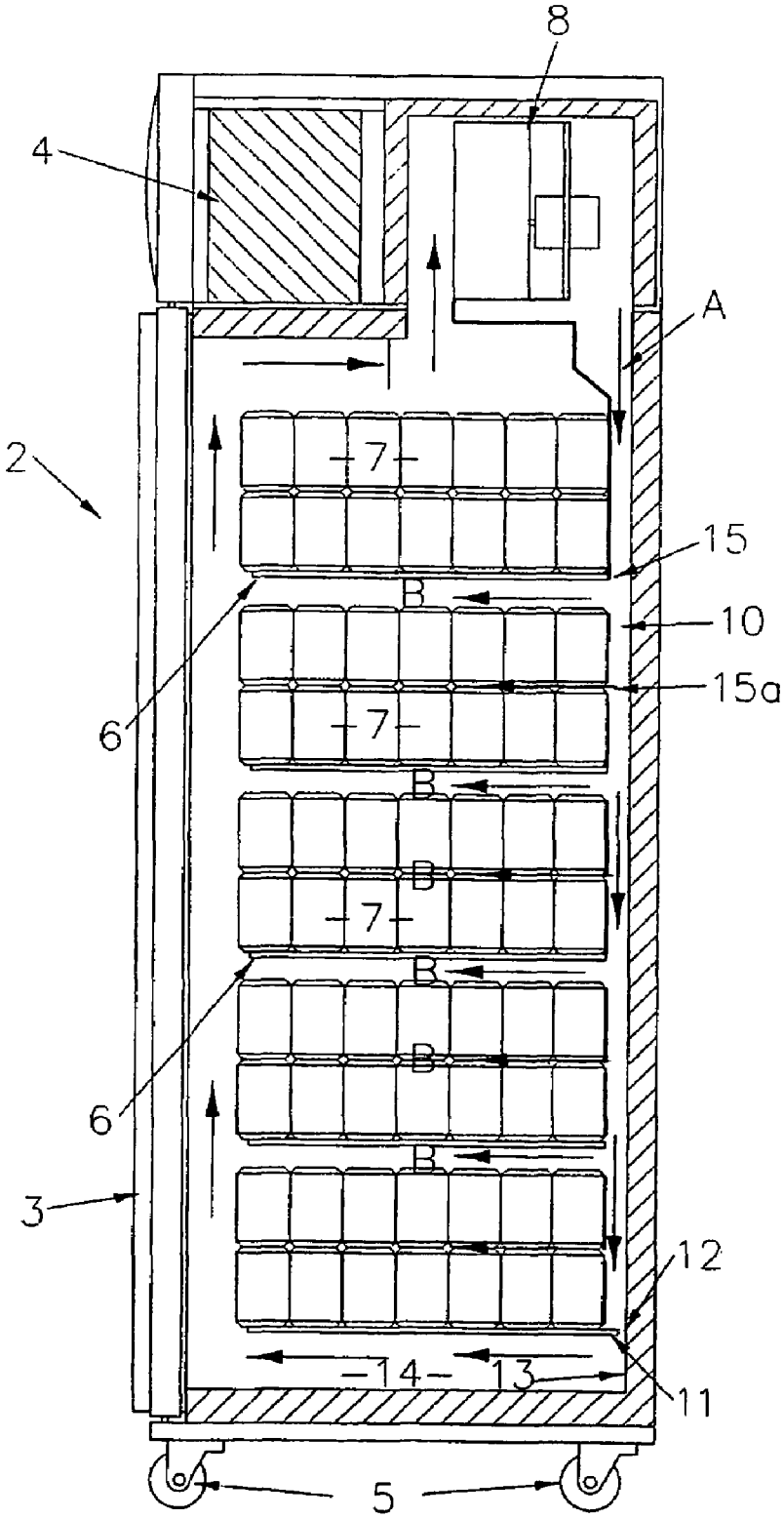
FIG. 1 shows a diagrammatic longitudinal section through a cabinet in accordance with a first embodiment of the invention.

The refrigeration unit 4 is of conventional type, and fitted with an air circulation fan 8 powered by a fan motor in known manner. On leaving the fan 8, the cold air (arrows A) passes down a duct 10 formed down the back of the cabinet, and extending across the full width of the back of the cabinet.

To keep the product 7 chilled efficiently, it is important that the cold air is circulated evenly around the interior of the cabinet. However, in known designs of cabinet, the path of least resistance for the cold air is to pass directly down the duct 10 to the bottom of the cabinet; this is especially so when the cabinet contains a large volume of product and the space between adjacent shelves 6 is restricted. It will be appreciated that this leads to inefficient chilling of the product.

To overcome this problem, the width of the duct 10 is restricted by a flange 11 which extends across the full width of the back of the cabinet and leaves only a small space between the outer end of the flange 11 and the rear wall 13 of the cabinet as the end outlet 12. The effect of this restriction is to make it more difficult for air to enter the bottom space 14 below the lowest shelf in the cabinet and thus to pressurize the air in the duct. This pressurization of the duct 10 forces air out through intermediate outlets 15,15*a*:- slots 15 formed across the duct 10 immediately below each of the cabinet shelves 6, (as indicated by Arrows B) and smaller slots 15*a* positioned between the slots 15; this gives a greatly improved distribution of air throughout the whole length of the cabinet.

The intermediate outlets 15,15*a* may be of any length, but typically are formed as a series of short slots across the width of the duct, of larger size than the end outlet 12.

Figure 2:
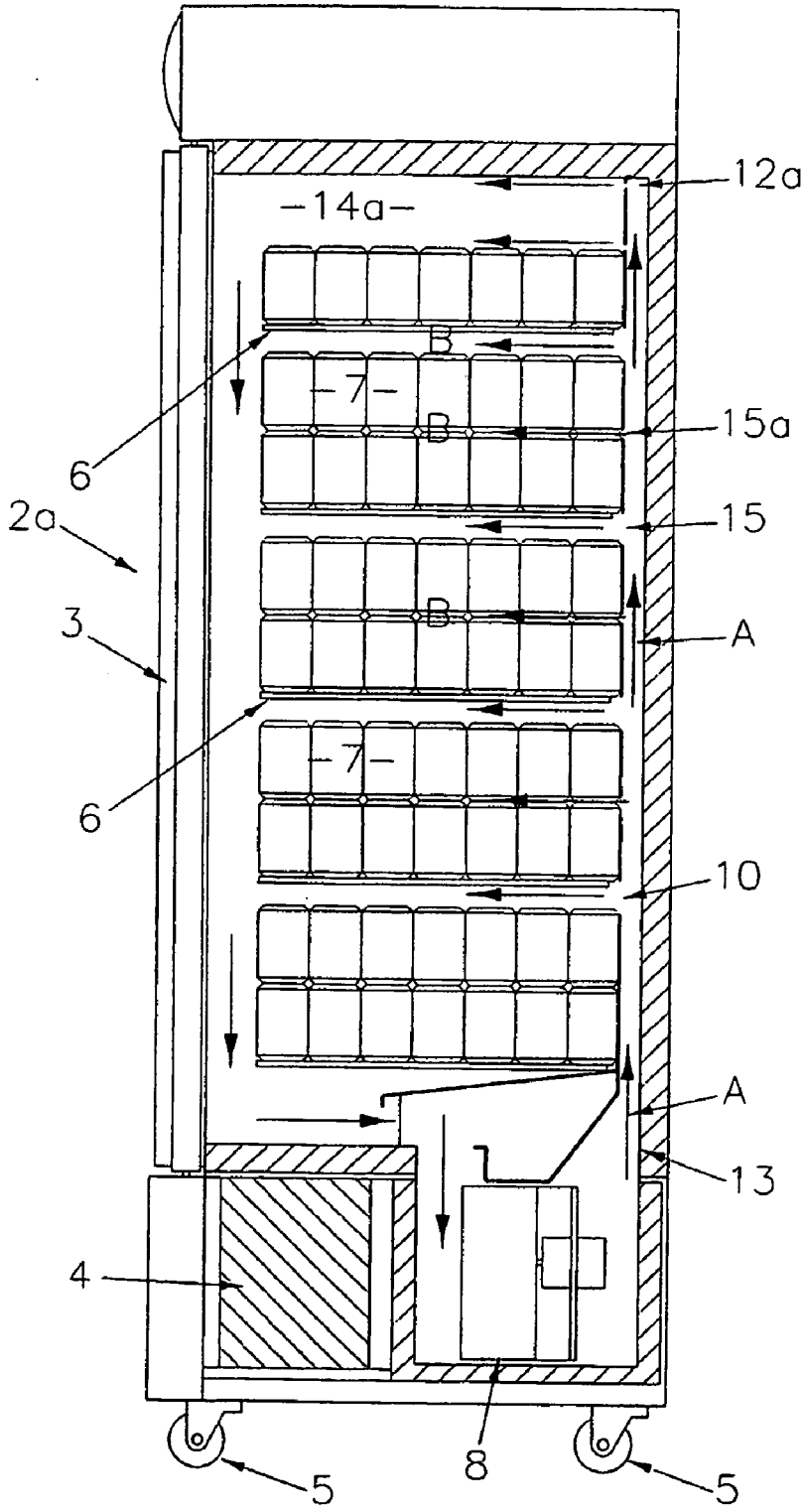
FIG. 2 shows a diagrammatic longitudinal section through a cabinet in accordance with a second embodiment of the invention.
Figure 3:
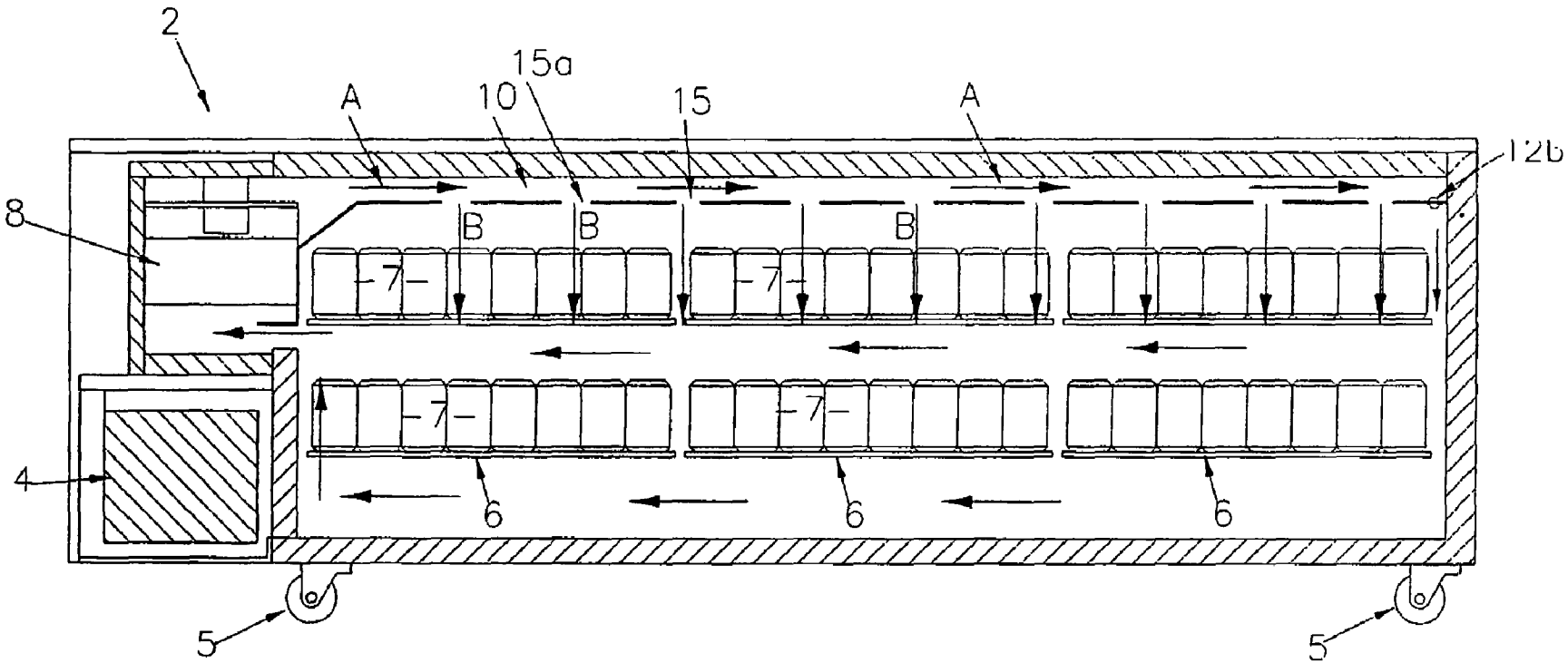
FIG. 3 shows a diagrammatic longitudinal section through a cabinet in accordance with a third embodiment of the invention.

The second and third embodiment as shown in FIGS. 2 and 3 are of the same general type of design as that of FIG. 1 and similar parts are given the same reference numerals.

In the embodiment of FIG. 2, the refrigeration unit 4 is mounted at the bottom of the cabinet, so that cold air (Arrow A) passes upwards from the bottom of the cabinet along the duct 10. The end outlet 12*a* is formed as a small aperture in the wall of the duct 10. In this embodiment, the width of the duct 10 remains constant adjacent the end outlet 12*a*, (i.e. there is no equivalent to flange 11, FIG. 1). The fact that the end outlet 12*a* is small compared to the intermediate outlets 15,15*a* has the effect of pressuring the air in the duct 10.

In the embodiment of FIG. 3, the refrigerated cabinet 2 is horizontal and the access door (not visible) is a hinged or sliding panel across the front of the cabinet. The refrigeration unit 4 is mounted at one end of the cabinet and the duct 10 is formed along the top of the cabinet. As in the FIG. 2 embodiment, the end outlet 12*b* of the duct is formed as a small aperture in the wall of the duct.

In FIGS. 2 and 3, the cold air coming from the refrigeration unit is indicated by Arrow A and the air circulating through the food storage area by Arrows B.

The invention claimed is:

1. A refrigerated cabinet which includes a fan assisted refrigeration unit and a duct in communication with said fan, said duct being adapted to distribute cold air from said fan throughout said cabinet;

wherein said duct extends substantially the full width and the full length of the product storage portion of the cabinet and at least a major portion of said duct has a substantially constant width; one end of said duct being in communication with the fan and the opposite end of said duct providing an end outlet; the portion of said duct between said ends being formed with a plurality of intermediate outlets adapted to supply air from said duct to the product storage portion of the cabinet; the size of said end outlet being substantially smaller than the size of said intermediate outlets, such that in use air in said duct is pressurized compared to the remainder of said cabinet.

2. The cabinet as claimed in claim 1, wherein said end outlet is formed by an aperture through the duct at or adjacent the end of the duct.

3. The cabinet as claimed in claim 1, wherein said end outlet is formed by a flange extending across part of the width of said duct.

4. The cabinet as claimed in any one of the preceding claims, wherein said fan assisted refrigeration unit is mounted at the top of the cabinet.

5. The cabinet as claimed in any one of claims 1–3, wherein said fan assisted refrigeration unit is mounted at the base of the cabinet.

6. The cabinet as claimed in any one of claims 1–3, wherein a fan assisted refrigeration unit is mounted at one end of the cabinet.

* * * * *